US006840821B2

(12) United States Patent
Bredow et al.

(10) Patent No.: US 6,840,821 B2
(45) Date of Patent: Jan. 11, 2005

(54) INJECTION-MOLDED ELEMENT

(75) Inventors: Wolfgang Bredow, Niefern-Öschelbronn (DE); Thomas Burchard, Pforzheim (DE); Thomas Haug, Ölbronn (DE)

(73) Assignee: Integrated Electronic Systems !SYS Consulting GmbH, Ölbronn-Dürrn (DE)

( * ) Notice: Subject to any disclaimer, the term of this patent is extended or adjusted under 35 U.S.C. 154(b) by 305 days.

(21) Appl. No.: 10/132,740

(22) Filed: Apr. 26, 2002

(65) Prior Publication Data

US 2002/0164904 A1 Nov. 7, 2002

(51) Int. Cl.[7] ..... H01R 13/405
(52) U.S. Cl. ..... 439/736
(58) Field of Search ..... 439/736, 620, 439/541.5, 676, 701, 79; 174/52.4, 52.2

(56) References Cited

U.S. PATENT DOCUMENTS

| | | | | |
|---|---|---|---|---|
| 4,395,134 A | | 7/1983 | Luce | |
| 5,941,123 A | | 8/1999 | Numakami | |
| 6,302,741 B1 | * | 10/2001 | Fasold et al. | 439/620 |
| 6,528,723 B2 | * | 3/2003 | Fries et al. | 174/52.4 |
| 6,656,076 B2 | * | 12/2003 | Strowik et al. | 475/178 |
| 2001/0006854 A1 | * | 7/2001 | Moriwake et al. | 439/78 |
| 2001/0039148 A1 | * | 11/2001 | Schreier et al. | 439/695 |
| 2002/0115518 A1 | * | 8/2002 | Strowik et al. | 475/178 |

FOREIGN PATENT DOCUMENTS

| | | |
|---|---|---|
| DE | 42 24 618 | 1/1994 |
| DE | 195 16 936 | 11/1996 |
| DE | 196 38 985 | 4/1998 |

* cited by examiner

*Primary Examiner*—J. F. Duverne
(74) *Attorney, Agent, or Firm*—Browdy and Neimark, P.L.L.C.

(57) ABSTRACT

An injection molded element in combination with at least one electrical contact element embedded in the injection molded element. The injection molded element forms a wall element of an electric or electronic device.

12 Claims, 3 Drawing Sheets

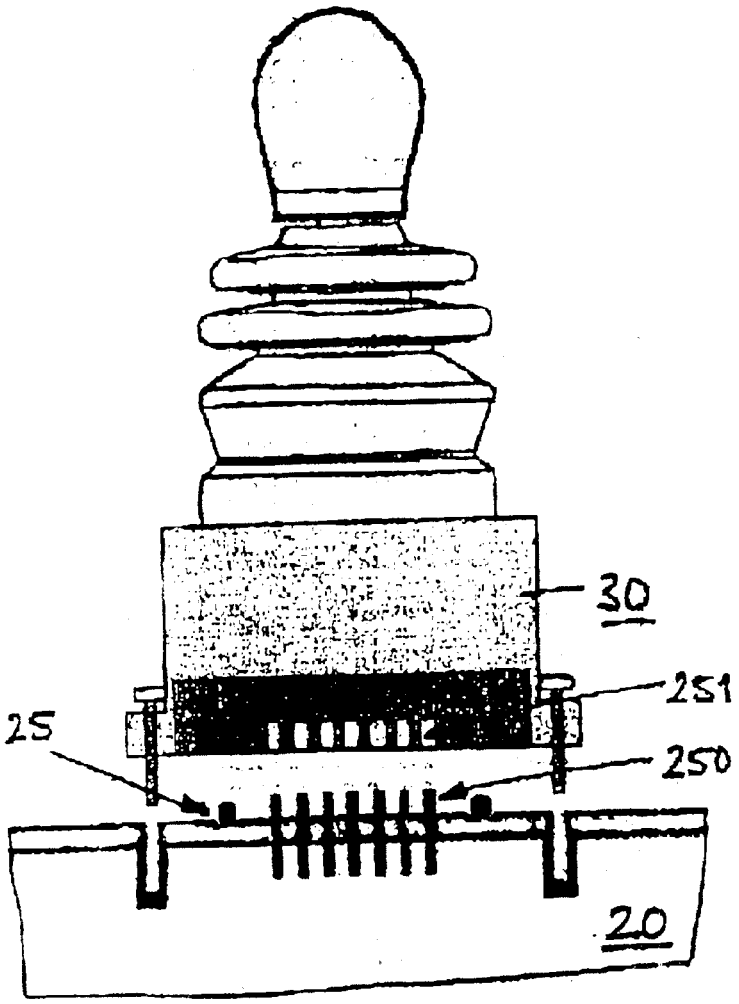
FIG. 2
FIG. 3
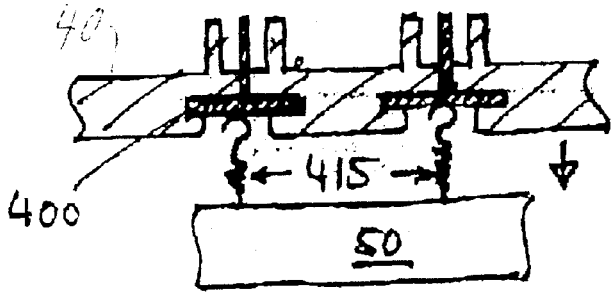

INJECTION-MOLDED ELEMENT

BACKGROUND OF THE INVENTION

The present invention relates to an injection-molded element having at least one electrical contact element embedded therein.

Such injection-molded elements are known in various designs and shapes and, together with the electrical contact elements embedded in them, as a rule they constitute plug-in connectors, in particular in the form of contact plugs or sockets, which are connected by cables, or also in the form of components which are fastened to the walls of devices or are inserted into openings of the latter.

In connection with the latter field of use, with which the invention is exclusively concerned, the connection between the plug or socket element and the housing of an electrical or electronic device as a rule requires screw or snap-in connections in order to provide mechanically secure seating. These connections have the disadvantage that the mechanical stability, and also the positioning, depend on the exact positioning of the receiver openings or fastening bores in the housing and that in particular, for example because of production tolerances, no seal against moisture and splashing water, or also soiling and contamination, can be provided as a rule. To prevent this, sometimes seal rings or the like are employed, which further increase the production costs.

BRIEF SUMMARY OF THE INVENTION

The present invention provides elements in which this undesirable interface between the housing and the connecting elements is eliminated.

In accordance with the invention, the molded element is formed to constitute a portion of the wall of an electric or electronic apparatus.

Thus, the simple concept of the invention lies in embodying the connecting area for making electrical connections as an integral part of the housing, or at least a part of the housing, for example a cover, so that connecting and sealing problems inherently do not occur. The technique of injection molding the molded element with preformed metal pins embedded therein also assures that a high degree of spatial and mechanical precision of the metal pins in respect to the housing can be achieved without noticeable production tolerances, which is of increasing importance, in particular in connection with very small devices or small connecting elements.

Thus, metal pins embedded in this way in the housing element constitute connector pins comparable to the corresponding components in the above mentioned conventional plug connectors.

In the same way it is also possible to embed other contact elements, for example metal plates, into the molded element during the injection-molding process, so that, for example, contact with a circuit component arranged inside the housing automatically takes place when the molded element is placed on the circuit component, or is brought into connection with it.

Injection-molding technology also permits a multitude of different contact elements to be provided in a simple manner in this way, wherein it is possible in particular to form identical groups of contact elements and to use them as connecting rails.

It is then possible to attach corresponding circuit elements to the inside of such a housing element, which for external uses is located opposite the connecting side, wherein it is possible here, too, to assure a defined positioning of these elements in relation to the inward projecting sections of the metal pins in order to assure a simple and secure inner connection of the metal pins with the associated circuit elements.

The invention is particularly advantageous if an electrical device, for example a remote-control transmitter consisting of an electronic block and a joystick block, is provided with complementary designed connecting elements at the associated housing, wherein a simple exchange of a device element for repair, cleaning or replacement purposes is possible, as well as simple mounting and dismounting, in particular.

Two exemplary embodiments of the invention will now be explained in greater detail with reference to the drawings.

BRIEF DESCRIPTION OF THE DRAWINGS

FIG. 2 is a pictorial view, partly in cross-section, of a remote-control transmitter including a molded element according to a second exemplary embodiment of the invention.

FIG. 3 is a simplified detail view of a molded element according to a third exemplary embodiment of the invention.

DETAILED DESCRIPTION OF THE INVENTION

Figure 1A:
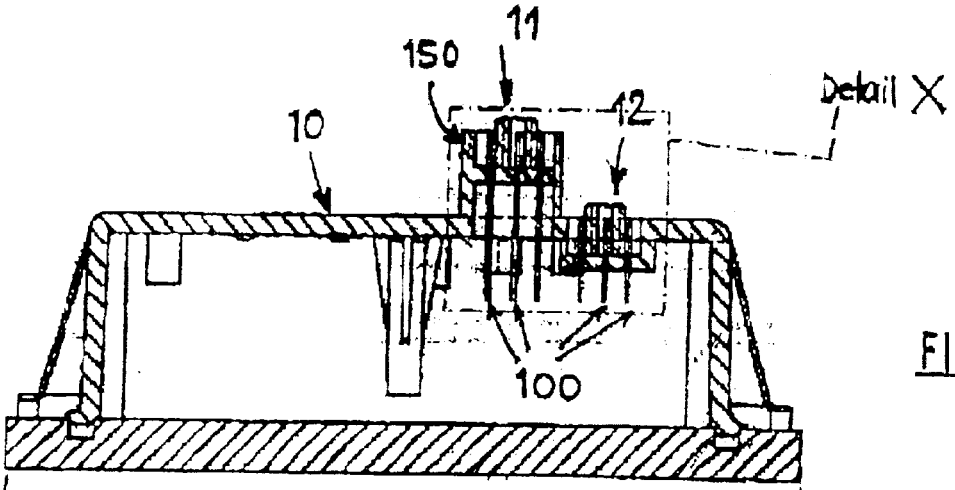
FIG. 1A is a cross-sectional view through a plane corresponding to the plane 1A—1A of FIG. 1B of a molded element according to a first exemplary embodiment of the invention.
Figure 1B:
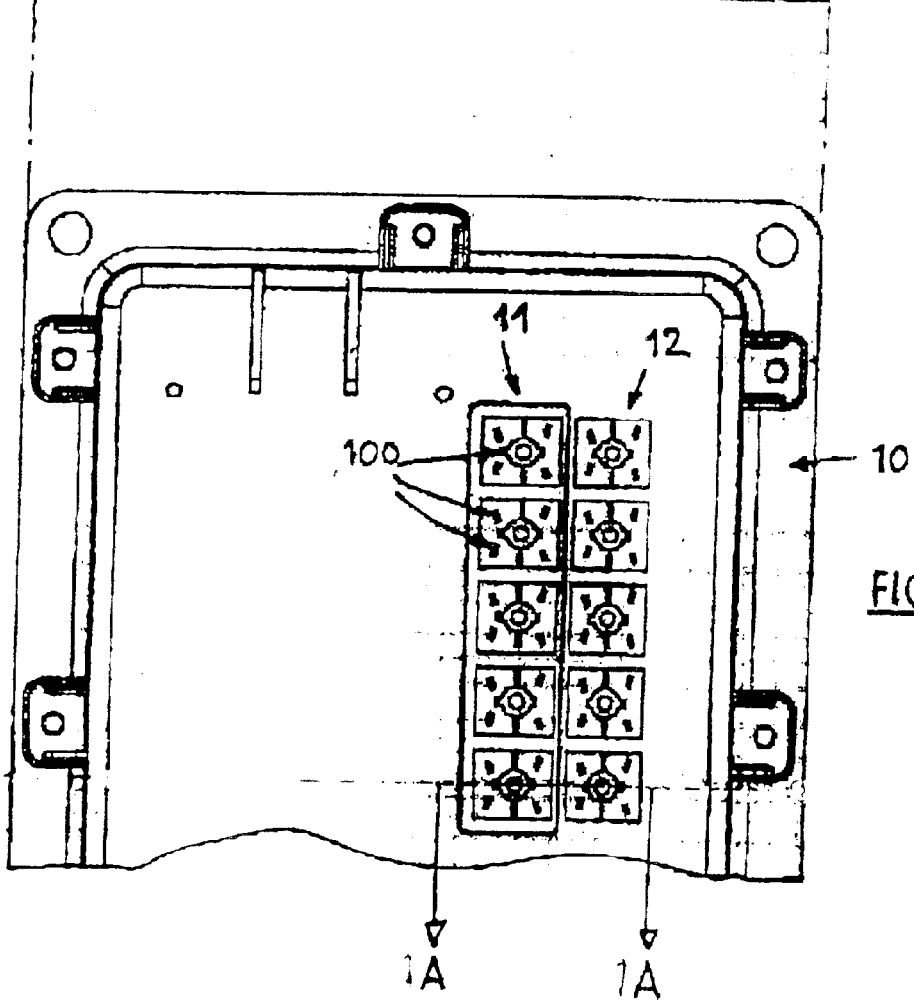
FIG. 1B is a top plan view of a portion of the molded element according to the first exemplary embodiment of the invention.
Figure 1C:
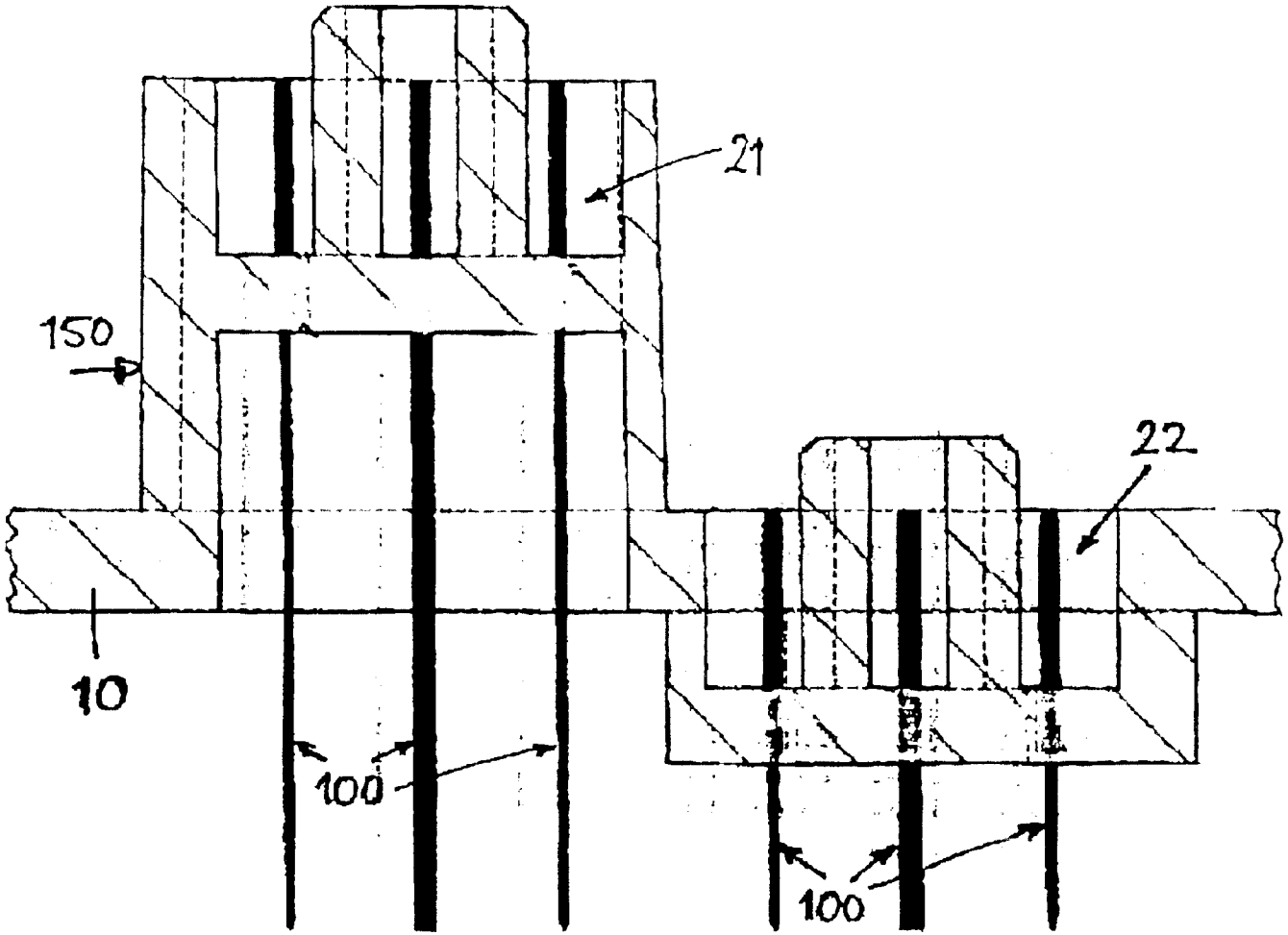
FIG. 1C is a detail view of the detail X of FIG. 1A taken along plane 1A—1A of FIG. 1B.

The first exemplary embodiment represented in FIGS. 1A to 1C includes a molded housing element 10 of an electrical device, which is has a hood or shell shape and on whose top are two connecting rails 11 and 12, which are used for making electrical connections with components arranged outside the device, in particular plugs or sockets. In accordance with the invention, these connecting rails 11 and 12 have been formed exclusively by an appropriate shaping of housing element 10, which was produced as an injection-molded element. During molding of housing element 10, metal pins 100 had been embedded at selected locations, the positioning of pins 100 within plastic molded element 10 is preselected in the course of the manufacturing process and can be exactly maintained.

In this case, various spatial designs of such connecting rails are conceivable. In the exemplary embodiment shown in FIGS. 1A–1C, the first connecting rail 11 is designed to be raised, which is achieved by providing molded element 10 with a circumferential collar 150, and the second connecting rail 12 is designed to be recessed. Otherwise, the shapes of the two connecting rails are identical in this exemplary embodiment. Specifically, each rail 11, 12 is composed of several connector groups, in the illustrated embodiment five, each group being composed of six metal pins 100 grouped around a central plastic element and possibly a further metal pin 100 enclosed by the plastic element. The central plastic element is a cylindrical sleeve, as shown most clearly in FIG. 1C. This arrangement can of course be matched to the respectively desired coupling structure such as, for example, a plug.

Metal pins 100 themselves extend toward the exterior. In the exemplary embodiment shown in FIGS. 1A–1C, the metal pins of connection rail 11 are flush with the upper edge of the collar 150 and the metal pins of connection rail 12 are flush with the upper edge of the surrounding portion of housing element 10. Metal pins 100 also extend toward the interior of housing element 10 far enough to allow pins 100 to be easily connected by a suitable technique to electric or electronic components provided in the interior of the housing. In the illustrated exemplary embodiment, the metal pins 100 are given different lengths for this purpose. Collar 150 is provided with a plurality of annular depressions 21, there being one depression 21 for each connector group of rail 11, and housing element 10 is provided with a plurality of annular depressions 22, there being one depression 22 for each connector group of rail 12, into which depressions the metal pins of the various connecting groups extend parallel with each other toward the exterior. In the illustrated embodiment, each depression 21, 22 has a square outline, although other outline shapes are possible.

The second exemplary embodiment represent in FIG. 2 shows the application of the inventive concept for the connection of two associated blocks to form a single device, wherein a remote-control transmitter has been selected as an example, such as is used, for example, for industrial remote-control operations.

The components required for remote control, in particular the remote-control transmitter, are located in an electronic block 20, the contact elements, such as relays or switches, which are required in particular for converting the pivot movements of a joystick into electrical signals and whose output signals constitute the basis of the remote--control signal emitted by the remote-control transmitter, are located in a joystick block 30 which also carries the joystick.

Here the invention provides that metal pins 250 are embedded into the molded cover, or housing element, of electronic block 20 and engage corresponding contact sockets 251 of the joystick block 30 in an electrically conductive manner. The joystick block 30 and the electronic block 20 can be sealingly screwed together and a seal ring 25 can be interposed between blocks 20 and 30 to seal the region containing pins 250 and sockets 251.

Because of this separation of the device into the electronic block 20 and the joystick block 30, a simple exchange of one of these two device blocks is possible in case of damage. In particular, this does not lead to an impairment or destruction of electronic components in the electronic block 20, if moisture or splashing water enters the joystick block 30, because the metal pins 250 form a hermetic seal with the cover of block 20 during the embedding and injection-molding process in the course of manufacturing the housing element of the electronic block 20. Therefore the common seal ring 25, which encloses the entire group of metal pins 250, is sufficient for sealing.

FIG. 3 shows a third exemplary embodiment in which the contact elements are metal plates 400 embedded in an injection molded housing element 40 during injection molding. As shown, each plate 400 may have a stem that extends through element 40 to allow an electrical connection to be made to each plate 400 from the side of element 40 that is opposite the side at which plate 400 is exposed. The stem helps to form a secure connection and hermetic seal between plate 400 and element 40. Each plate 400 is positioned to make electrical contact with an associated contact element 415 mounted in an electrical device 50 that is to be covered by element 40.

This application relates to subject matter disclosed in German Application Number 101 20 362.41, filed on Apr. 26, 2001, the disclosure of which is incorporated herein by reference.

The foregoing description of the specific embodiments will so fully reveal the general nature of the invention that others can, by applying current knowledge, readily modify and/or adapt for various applications such specific embodiments without undue experimentation and without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation. The means, materials, and steps for carrying out various disclosed functions may take a variety of alternative forms without departing from the invention.

Thus the expressions "means to . . . " and "means for . . . ", or any method step language, as may be found in the specification above and/or in the claims below, followed by a functional statement, are intended to define and cover whatever structural, physical, chemical or electrical element or structure, or whatever method step, which may now or in the future exist which carries out the recited function, whether or not precisely equivalent to the embodiment or embodiments disclosed in the specification above, i.e., other means or steps for carrying out the same functions can be used; and it is intended that such expressions be given their broadest interpretation.

What is claimed is:

1. An electric or electronic device including a housing enclosing circuit elements, wherein the housing has a wall element constituting an injection molded element in combination with first and second electrical contact elements embedded in said injection molded element, wherein each of said contact elements comprises at least one pin, said first contact element projects from said molded element and said second contact element is recessed in said molded element.

2. The device in accordance with claim 1, wherein said molded element constitutes at least one outer wall in the form of a housing or housing element (10) of the device.

3. The device in accordance with claim 1, wherein said molded element constitutes at least partially an inner wall in the form of a separating wall or intermediate bottom of the device.

4. The device in accordance with claim 1, wherein said pin is a metal pin (100, 250), which extends through said wall element.

5. The device in accordance with claim 1, wherein said at least one contact element further comprises a metal plate (400) connected to said pin and embedded in said wall element to allow electrical contact to be made on both sides of said wall element.

6. The device in accordance with claim 4, wherein said at least one metal pin comprises a plurality of metal pins (100, 250) arranged in groups in said molded element.

7. The device in accordance with claim 4, wherein said molded element comprises a plug or socket in the immediate vicinity of said at least one metal pin (100).

8. The device in accordance with claim 7, wherein said plug or socket includes a collar (150) surrounding said at least one metal pin (100).

9. The device in accordance with claim 6, wherein several of said groups of metal pins (100) are identical and are combined into a connecting rail (11, 12) of said molded element.

10. The device in accordance with claim 8, wherein said molded element comprises a housing having a depression (21, 22), and said at least one metal pin (100) comprises a plurality of metal pins (100) arranged in said depression.

11. An electric or electronic device including a housing enclosing circuit elements, wherein the housing has a wall element constituting an injection molded element in combination with at least one electrical contact element embedded in said injection molded element, wherein said contact element comprises a metal pin that extends through said wall element and that is configured and supported to be inserted in a respective contact socket, wherein the device is a remote-control transmitter with a joystick, said molded element constitutes a part of a housing of an electronic block (20) on which a joystick block (30) is placed and fixed in place so as to make electrical connections via said at least one metal pin (250).

12. The device in accordance with claim 11, further comprising a seal (25) provided between the electronic block (20) and the joystick block (30).

* * * * *